United States Patent [19]

Bell

[11] Patent Number: 4,657,293

[45] Date of Patent: Apr. 14, 1987

[54] DOOR JAMMER LOCK

[75] Inventor: L. James Bell, Willowdale, Canada

[73] Assignee: O. Ruben Pettersson, Toronto, Canada

[21] Appl. No.: 718,119

[22] Filed: Mar. 29, 1985

[51] Int. Cl.[4] ..... E05C 17/54

[52] U.S. Cl. ..... 292/258; 292/339; 292/244

[58] Field of Search ..... 292/258, 288, 338, 339, 292/244

[56] References Cited

U.S. PATENT DOCUMENTS

| | | | |
|---|---|---|---|
| 112,673 | 3/1871 | Anderson | 292/DIG. 15 X |
| 551,569 | 12/1895 | Barnes | 292/DIG. 15 X |
| 709,057 | 9/1902 | Smith | 292/339 |
| 778,823 | 12/1904 | Fay | 292/339 |
| 2,595,709 | 5/1952 | Sande | 292/339 |
| 2,739,005 | 3/1956 | Naffziger | 292/339 |
| 2,774,622 | 12/1956 | Priebe | 292/339 X |
| 3,287,050 | 11/1966 | Ferrante | 292/244 |
| 4,198,088 | 4/1980 | Tochihara | 292/DIG. 15 X |

*Primary Examiner*—Richard E. Moore

*Attorney, Agent, or Firm*—R. Craig Armstrong

[57] ABSTRACT

A door jammer device for preventing opening from the outside of a inward-opening door is disclosed, comprising a substantially U-shaped member having a shorter arm, a longer arm, and a base. Screw means are installed though a threaded hole through the longer arm towards the shorter arm, for attaching the member to the door by clamping the door between the screw means and the shorter arm. A jamming member is pivotally attached to the longer arm and angles downwardly away from the U-shaped member to engage the floor. Thus, a door may be locked by tightening the screw means to clamp the device to the outside edge of the door near the floor, such that the jamming member engages the floor. The jamming member has downwardly protruding teeth at its floor-engaging end, and angles downwardly at an angle of approximately 15 to 20 degrees from the horizontal.

1 Claim, 4 Drawing Figures

DOOR JAMMER LOCK

BACKGROUND OF THE INVENTION

This invention relates to security devices, and particularly to a device for jamming an inward-opening door from the inside to prevent opening from the outside.

Security devices are of course much in demand in today's security. Many different devices are on the market, but nevertheless there exists a need for a simple device which can be used by householders and travellers in particular as an auxiliary locking device, in addition to conventional installed door hardware and locks.

SUMMARY OF THE INVENTION

It is an object of the invention to provide a simple device for jamming an inward-opening door from the inside to prevent opening from the outside.

Thus in accordance with the present invention there is provided a door jammer device for preventing opening from the outside of a inward-opening door, comprising a substantially U-shaped member having a shorter arm, a longer arm, and a base. Screw means are installed through a threaded hole through the longer arm towards the shorter arm, for attaching the member to the door by clamping the door between the screw means and the shorter arm. A jamming member is pivotally attached to the longer arm and angles downwardly away from the U-shaped member to engage the floor. Thus, a door may be locked by tightening the screw means to clamp the device to the outside edge of the door near the floor, such that the jamming member engages the floor.

In accordance with other features of the invention, the jamming member may have downwardly protruding teeth at its floor-engaging end, and the jamming member may angle downwardly at an angle of approximately 15 to 20 degrees from the horizontal.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
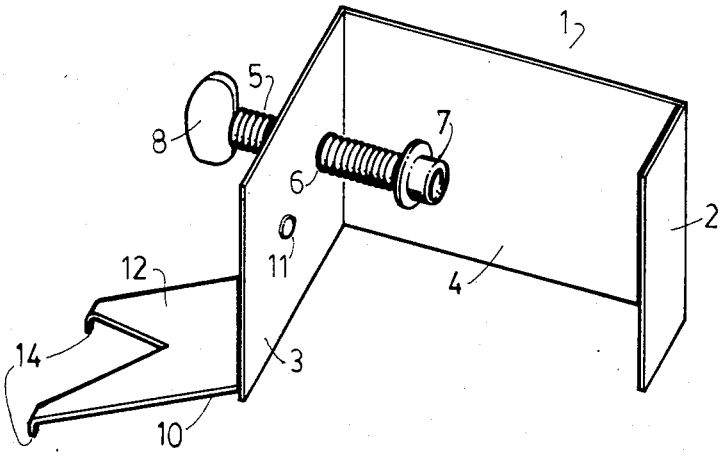
FIG. 1 is an oblique view of the preferred embodiment of the door jammer lock of the present invention.
Figure 2:
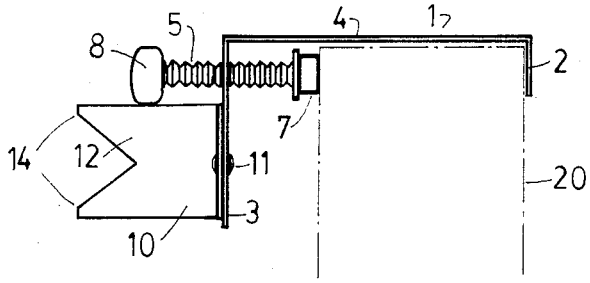
FIG. 2 is a top view, showing the jammer installed on a door.
Figure 3:
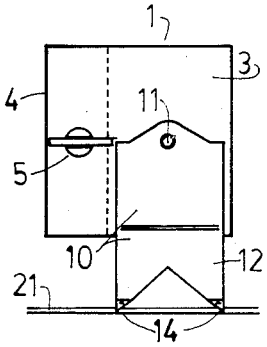
FIG. 3 is an elevation view corresponding to FIG. 2.
Figure 4:
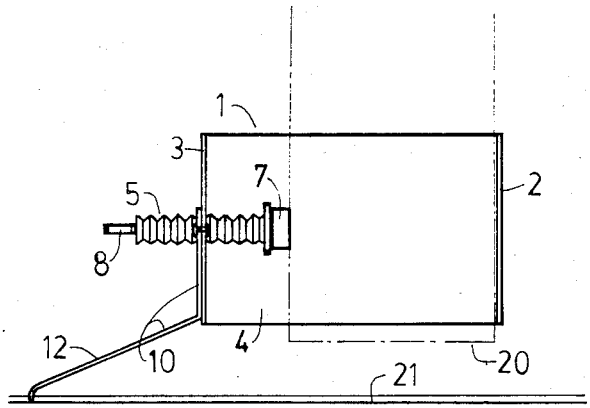
FIG. 4 is an end view corresponding to FIG. 2.

The preferred embodiment of the door jammer device consists essentially of a U-shaped member 1 having a shorter arm 2, a longer arm 3 and a base 4. Screw means, such as a bolt 5, are installed through a threaded hole 6 in the longer arm. Pressed onto the end of the bolt 5 is a clamping cap 7. The U-shaped member 1 is attached to the outside edge of a door 20 near the floor 21, simply by turning the bolt 5 to clamp the door between the clamping cap 7 and the shorter arm 2. The end of the bolt remote from the clamping cap is provided with a handle 8 to facilitate tightening.

Pivotally connected to the longer arm 3 is a jamming member 10. A rivet 11 located half way up the longer arm 3 acts as the pivot point. The jamming member has a jamming arm 12 which projects downwardly towards the floor at an angle of approximately 15 to 20 degrees from the horizontal. At the end of the jamming arm are two teeth 14 which engage the floor 21.

The fact that the jamming member may be pivoted means that the device may be used for either a right-hand opening or left-hand opening door.

It will be appreciated that the above description relates to the preferred embodiment by way of example only. Variations on the invention will be obvious to those knowledgeable in the field, and such obvious variations are within the scope of the invention as described and claimed, whether or not expressly described.

What is claimed as the invention is:

1. A door jammer device for attachment to the outside edge of a door near the floor, for preventing opening from the outside of an inward opening door, comprising:

a substantially U-shaped member having a shorter arm, a longer arm, and a base;

screw means installed through a threaded hole through said longer arm towards said shorter arm, for attaching said member to said door by clamping said door between the screw means and said shorter arm; and a substantially L-shaped jamming member having a vertical arm and an arm which angles downwardly at an angle of approximately fifteen to twenty degrees to the horizontal;

where said vertical arm is pivotally attached to said longer arm of the U-shaped member, for pivoting about a horizontal axis perpendicular to the plane of said door, and said horizontal arm of said jamming member angles downwardly away from said U-shaped member to engage the floor;

whereby said door may be locked by tightening said screw means to clamp the device to the outside edge of the door near the floor, such that the jamming member engages the floor.

* * * * *